United States Patent [19]

Farrier

[11] Patent Number: 5,031,557

[45] Date of Patent: Jul. 16, 1991

[54] FLOAT CONNECTION ASSEMBLY CONSTRUCTION METHOD FOR TRIMARANS

[76] Inventor: Ian L. Farrier, 320 Pearlwood St., Chula Vista, Calif. 92011

[21] Appl. No.: 407,222

[22] Filed: Aug. 28, 1989

[51] Int. Cl.[5] ..... B63B 3/14

[52] U.S. Cl. ..... 114/61; 114/65 R

[58] Field of Search ..... 114/61, 292, 283, 123, 114/65 R

[56] References Cited

U.S. PATENT DOCUMENTS 3,937,166 2/1976 Lindsay ..... 114/123

4,474,128 10/1984 Wallach ..... 114/61 X

*Primary Examiner*—Sherman Basinger

*Attorney, Agent, or Firm*—Charles C. Logan, II

[57] ABSTRACT

A molded or pre-fabricated Central Core Unit module, containing the aligned attachment points, surfaces, or brackets necessary for incorporating the Float Connection Assemblies for the retraction of a trimaran's stabilizing floats, to be along side the center hull of a trimaran. The Float Connection Assemblies are attached to and aligned by this Central Core Unit. The Core Unit module replaces a number of brackets or surfaces and bulkheads that had to be independently constructed and aligned in the central hull. With the Central Core Unit module, the Float Connection Assemblies can be self-contained and independent from the trimaran hulls, which can then be constructed of any material. The Central Core Unit module and associated Float Connection Assemblies can be removable and used in a wide range of trimaran designs of similar size.

3 Claims, 1 Drawing Sheets

FLOAT CONNECTION ASSEMBLY CONSTRUCTION METHOD FOR TRIMARANS

Figure 3:
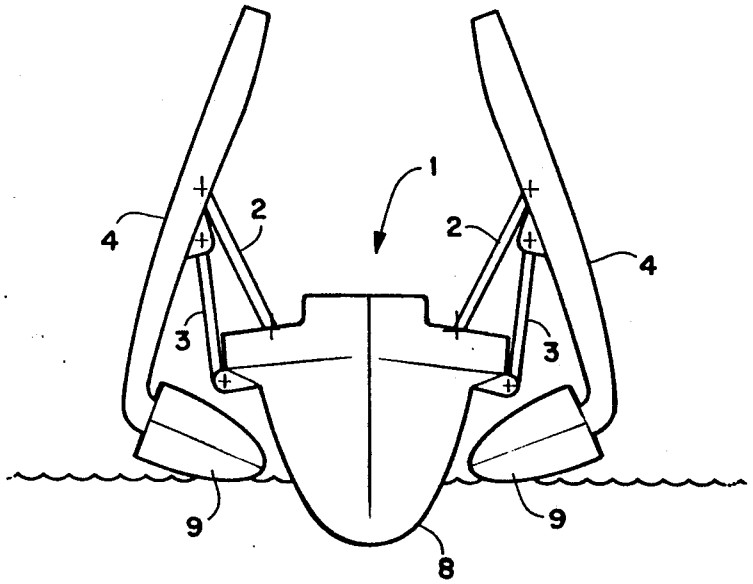

This invention relates to a new construction method for the incorporation of the Float Connection Assemblies as described in U.S. Pat. No. 3,937,166 into a trimaran to enable faster and easier building of such boats.

BACKGROUND OF THE INVENTION

Wide beam has always been a problem with trimarans, and the Float Connection Assemblies as described in U.S. Pat. No. 3,937,166 have solved this with a simple and effective method of retracting the stabilizing floats of a trimaran. The system is now widely used. However, the incorporation of these Float Connection Assemblies into a trimaran has proven to be difficult and time consuming.

Two construction methods have been used. The first is the standard wood frame, stringers and plywood planking construction method. With this method the Float Connection Assemblies require two carefully aligned bulkheads or frames either side of each connecting beam, to which pivot brackets are then attached. The position of these bulkheads is critical for accurate alignment of the connecting beams and the pivot assemblies. These bulkheads are of the usual wood frame type construction, and are used to support wood stringers, which in turn support plywood planking. In accordance with normal boat building practice these are built in during construction of the hull, and the pivot brackets must then be carefully attached and aligned. Accurately aligned mounting surfaces for the connecting beams must also be established between the bulkheads.

While this method has been reasonably successful, it requires a high level of building skill, a considerable amount of labor, and the two bulkheads take up interior room. The attachment of these bulkheads to the hull structure can be very important, and may limit the type of materials used to that as originally designed. Being a very labor intensive process, this method is not suitable for commercially produced trimarans and has only been used for amateur built trimarans.

The second construction method is the well established fiberglass production method of utilizing female molds in which the fiberglass hull is formed. With this construction a single fiberglass bulkhead at the center of each connecting beam is used in conjunction with very accurately aligned hull surfaces in this area, to provide correctly aligned mounting surfaces for the pivot brackets for the guide frame assemblies and a mounting surface or recess for the connecting beams. This method offers labor savings compared to the first method, but requires a considerable initial investment in very close tolerance tooling and is only suitable for production type molded fiberglass trimarans.

Both methods require integrating the Float Connection Assemblies, and their associated supports, piece by piece, very accurately, into the boat structure as it is built. This requires very detailed design, considerable building skills, very careful alignment, and a lot of labor.

Construction materials for the boat are also limited to what the designer has specified, due to the many varied stresses involved, and their resolution into the particular materials specified.

In all cases, the Float Connection Assemblies have been designed for a specific design, and are not suitable for use in other similar but different designs. A simple change in design shape of the hulls may require a complete redesign of the Float Connection Assemblies. Once a trimaran using this system is assembled, the Connecting Assemblies became part of that boat and can not be easily transferred to a similar size but different trimaran design. This is a particular disadvantage for racing trimarans, where a hull design is easily outdated, and a new hull design may be required. The ability to transfer the Float Connection Assemblies easily into a new central hull and/or stabilizing floats would offer great savings in time and expense.

It is, therefore, an object of this invention is to provide a construction method that will overcome the above and other disadvantages, and a method that will be easy and efficient to use. In particular, it is an object of this invention to provide a construction method in which the assembly of many different parts is not required. Other objects are to provide a construction method that eliminates accurate alignment of many different parts, and to provide a construction method that is independent of the materials used in the rest of the craft.

SUMMARY OF THE INVENTION

With the foregoing and other objects in view, this invention resides broadly in a molded, or fabricated Central Core Unit, which can be incorporated into the center hull of a trimaran at any time during construction. This Central Core Unit contains the correctly aligned attachment points, surfaces, or brackets, as required, for mounting the Float Connection Assemblies, either individually or as sub-assemblies. There are two Central Core Units used with the main hull of a trimaran. Upon completion of the central hull, and incorporation of the Central Core Unit, the Float Connection Assemblies (such as seen in the Farrier U.S. Pat. No. 3,937,166) are attached to and aligned by the Central Core Unit. The outer floats can then be attached.

Should the trimaran design, or parts thereof, later become redundant, or unsuitable, then the Float Connection Assemblies and Central Core unit can be easily removed and fitted into a new design. A range of standard Central Core Units can be manufactured for different size trimarans.

Figure 1:
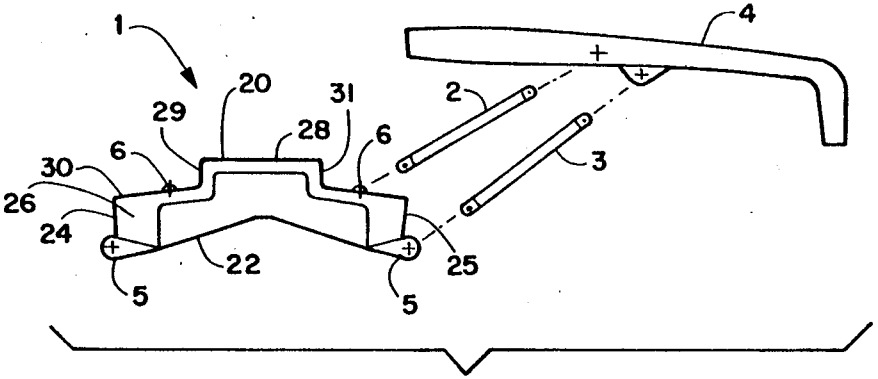

In order that the invention may be more readily understood and put into practical effect, reference will now be made to the accompanying drawings, which illustrate a preferred embodiment of the invention and wherein:

FIG. 1. is a front view of the Central Core Unit, with a Float Connection Assembly on one side.

Figure 2:
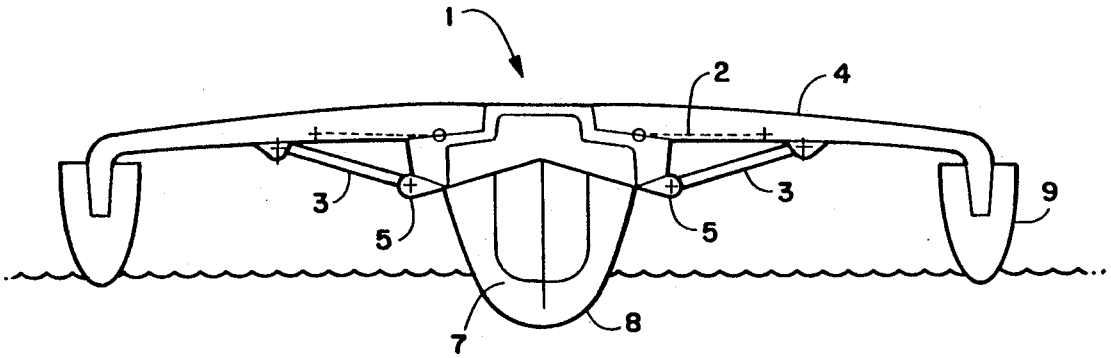

FIG. 2. is a view of the Central Core unit incorporated into a trimaran with the Float Connection Assemblies attached.

FIG. 3. is a view of the completed boat with the Floats retracted by the Float Connection Assemblies.

Referring now to the drawings, there are shown Float Connection Assemblies, consisting of the Upper Pivoting Guide Frames 2, the Lower Pivoting Guide Frames 3 and the Connecting Beams 4, which are attached to the Central Core Unit 1. The Central Core Unit is completely self-contained, and separate to the hull, with pivoting brackets or pivot points (5 and 6) for the pivoting Guide Frames (2 and 3) either molded in, or bolted in place on aligned surfaces. This Central Core Unit is all that is required to be fitted into the center hull of a trimaran 8 in order to incorporate the Float Connection Assemblies.

The Central Core Unit has a top wall assembly 20, a bottom wall 22, an upright outer left side wall 24 and an upright outer right side wall 25. It also has a front wall 26 and a rear wall (not shown). Top wall assembly 20 has a central portion 28, an upright left inner side wall 29, a transversely extending left side upper support wall 30, an upright right inner side wall 31 and a transversely extending right side upper support wall 32.

The Central Core unit may be simplified, if required, by being designed to just provide an aligned mounting platform for the Connecting Beams 4, whereupon some or all of the pivot brackets (5 and 6) are mounted in some other way to the hull.

The Central Core Unit may be designed to be structurally independent, and not need any structural reinforcement from the central hull. It can be installed after the hull is completed and the only requirements to fit are that the two Central Core units for the usual forward and aft sets of Float Connecting Assemblies are level and the correct distance apart. If required, a single bulkhead 7 can then complete the installation.

Once the Central Core Unit is installed, and the Float Connecting Assemblies attached, the floats 9 can then be fixed to the connecting beams 4.

With the Central Core Unit and Float Connection Assemblies being independent and self-contained, the construction method or materials for the central hull or the outer float hulls can be of any type.

The Connecting Beams 4 can be of a universal design so as to fit in a wide range of individual trimaran designs, of similar size and proportion, in both central hull, and the outer floats.

With this method of construction, both the Float Connection Assemblies and the Central Core unit can be manufactured in volume, and supplied to individual builders for incorporating in many different designs. This eliminates the present hand building, installation piece by piece, and accurate alignment of the many different parts that make up the Float Connection Assemblies.

The advantages of this method are the considerable savings in time, less skill required in building, any material can be used to construct the hulls, and the same standard pre-made Central Core Unit and Float Connection Assemblies can be utilized in many different designs.

While the above has been given by way of illustrative example, it will, of course, be realized that many modifications of constructional detail and design may be made to the described embodiment and that the features of the invention may be utilized on other multi-hulled boats by persons skilled in the art without departing from the broad scope and ambit of the invention as is defined in the appended claims.

What I claim is:

1. A central core unit module for a trimaran that provides structure for pivotally attaching laterally extending left and right side connecting beams that have floats secured to their outer ends comprising:

said central core unit module having a longitudinally extending axis, a top wall assembly, a bottom wall, and upright outer right and left side walls;

said top wall assembly having a transverse extending central portion that has a left edge and a right edge;

said top wall assembly also having transversely extending right and left side upper support walls and they each have an inner edge and an outer edge;

first pivotal support means for securing an inner end of an upper pivoting guide frame adjacent said transversely extending right side upper support wall, said first pivotal support means having a longitudinally extending axis that is laterally offset and parallel to the longitudinal axis of said central core unit module;

second pivotal support means for securing an inner end of an upper pivoting guide frame adjacent said transversely extending left side upper support wall, said second pivotal support means having a longitudinally extending axis that is laterally offset and parallel to the longitudinal axis of said central core unit module;

third pivotal support means for securing an inner end of a lower pivoting guide frame adjacent said upright outer right side wall, said third pivotal support means having a longitudinally extending axis that is laterally offset and parallel to the longitudinal axis of said central core unit module; and fourth pivotal support means for securing an inner end of a lower pivoting guide frame adjacent said upright outer left side wall, said fourth pivotal support means having a longitudinally extending axis that is laterally offset and parallel to the longitudinal axis of said central core unit module.

2. A central core unit module as recited in claim 1 further comprising:

an upright right inner side wall having a top end and a bottom end, said top end being connected to the right edge of the central portion of said top wall assembly, said bottom end being connected to the inner edge of said transversely extending right side upper support wall; and an upright left inner side wall having a top end and a bottom end, said top end being connected to the left edge of the central portion of said top wall assembly, said bottom end being connected to the inner edge of said transversely extending left side upper support wall.

3. A central core unit module as recited in claim 1 wherein:

the inner end of said right side upper pivoting guide frame is secured to said first pivotal support means and its outer end is pivotally secured to said right side connecting beam;

the inner end of said right side lower pivoting guide frame is secured to said third pivotal support means and its outer end is pivotally secured to said right side connecting beam;

the inner end of said left side upper pivoting guide frame is secured to said second pivotal support means and its outer end is pivotally secured to said left side connecting beam; and the inner end of left side lower pivoting guide frame is secured to said fourth pivotal support means and its outer end is pivotally secured to said left side connecting beam.

* * * * *